US011566507B2

(12) United States Patent
Ejim

(10) Patent No.: US 11,566,507 B2
(45) Date of Patent: Jan. 31, 2023

(54) THROUGH-TUBING SIMULTANEOUS GAS AND LIQUID PRODUCTION METHOD AND SYSTEM

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 203 days.

(21) Appl. No.: 17/003,134

(22) Filed: Aug. 26, 2020

(65) Prior Publication Data

US 2022/0065090 A1 Mar. 3, 2022

(51) Int. Cl.

| | |
|---|---|
| ***E21B 43/38*** | (2006.01) |
| ***E21B 47/008*** | (2012.01) |
| ***E21B 43/12*** | (2006.01) |
| ***F04B 47/06*** | (2006.01) |

(52) U.S. Cl.

CPC ..... *E21B 43/38* (2013.01); *E21B 43/128* (2013.01); *E21B 47/008* (2020.05); *F04B 47/06* (2013.01)

(58) Field of Classification Search

CPC ..... E21B 43/38; E21B 43/128; E21B 47/008; E21B 2200/01; F04B 47/06

See application file for complete search history.

(56) References Cited

U.S. PATENT DOCUMENTS 4,982,794 A 1/1991 Houot
6,179,056 B1 * 1/2001 Smith ..... E21B 43/38 166/313
9,638,015 B2 * 5/2017 Nowitzki ..... F04D 29/628
2003/0145989 A1 * 8/2003 Shaw ..... E21B 43/128 166/265
2010/0258306 A1 10/2010 Camilleri et al.
(Continued)

FOREIGN PATENT DOCUMENTS

CN 110284870 A 9/2019
WO 2004/023053 A2 3/2004
(Continued)

OTHER PUBLICATIONS

International Search Report and Written Opinion issued in Application No. PCT/US2020/049366, dated Apr. 28, 2021 (15 pages).

*Primary Examiner* — Abby J Flynn
*Assistant Examiner* — Yanick A Akaragwe
(74) *Attorney, Agent, or Firm* — Osha Bergman Watanabe & Burton LLP

(57) ABSTRACT

A system includes a first tubing arranged within a second tubing. A first flow path is formed within the second tubing, and a second flow path is formed between the first tubing and the second tubing. A pump is disposed within the first tubing and has a discharge end that is fluidly connected to the first flow path. A seal fitting coupled to a distal end of the first tubing includes a third flow path and a sealing arrangement to isolate the second flow path from a portion of an external environment of the first tubing. A gas separator is positioned to receive a fluid mixture stream from the third flow path and separate the fluid mixture stream into a gas stream that is directed into the second flow path and a liquid-rich fluid stream that is directed into the pump.

16 Claims, 6 Drawing Sheets

(56) References Cited

U.S. PATENT DOCUMENTS

| | | | | |
|---|---|---|---|---|
| 2011/0162832 | A1* | 7/2011 | Reid | E21B 43/128 166/244.1 |
| 2013/0043031 | A1 | 2/2013 | Tunget | |
| 2013/0259721 | A1 | 10/2013 | Noui-Mehidi et al. | |
| 2016/0222770 | A1 | 8/2016 | Kirk et al. | |
| 2018/0038210 | A1 | 2/2018 | Xiao et al. | |
| 2019/0234193 | A1* | 8/2019 | Fehri | F04B 47/06 |

FOREIGN PATENT DOCUMENTS

| | | | |
|---|---|---|---|
| WO | 2014/058778 | A1 | 4/2014 |
| WO | 2018005432 | A1 | 1/2018 |
| WO | 2018/132927 | A1 | 7/2018 |

* cited by examiner

THROUGH-TUBING SIMULTANEOUS GAS AND LIQUID PRODUCTION METHOD AND SYSTEM

BACKGROUND

The electric submersible pump (ESP) is used to lift fluids from a well to a surface or from one surface location to another. Typical components of the ESP system include pump section, seal section, motor, power cable, surface motor controller, and optional components such as a monitoring tool. The motor provides the mechanical power to drive the pump section via a shaft and is powered from the surface via the power cable. The seal section, which is typically located directly above or below the motor depending on the configuration of the ESP system, is coupled to the shaft between the motor and the pump and prevents well fluids from migrating into the motor. The seal section may perform various other functions, such as absorbing the axial thrust produced by the pump and equalizing pressure between the interior of the motor and the well. The downhole components of the ESP system may be deployed into the well via a jointed production tubing or via a coiled tubing, with coiled tubing deployment being generally faster due to not having to make up threaded joints. The power cable extends from the surface motor controller to the motor downhole. The power cable may be attached externally to the production tubing. Alternatively, the power cable may be attached externally to the coiled tubing or disposed inside the coiled tubing.

ESP systems typically use centrifugal pumps or progressive cavity pumps in the pump section. ESP systems operate favorably when handling liquids. However, their performance deteriorates when operating in wells with fluids having a high free gas content compared to the liquid content. In these cases, measures need to be taken to handle the excess free gas. One measure involves using a gas separator upstream of the pump section to extract the gas from the gas-liquid mixture. The extracted gas may be expelled into the well or produced up a casing annulus in the well. The residual liquid-rich fluid stream is discharged from the gas separator into the ESP pump section, where the liquid is pressurized and then produced to a wellhead at the surface via a production tubing. In cases where production of fluid up the casing annulus is prohibited, multiphase pumps or gas handlers are installed upstream of the ESP pump section to homogenize the fluid mixture and increase pressure at the intake of the ESP pump section, forcing the fluid mixture through the ESP pump section. Gas separators separate gas-liquid mixture into a gas stream and a liquid stream and discharge the separated fluids through respective ports. The liquid stream is discharged into a pump, and the gas stream is discharged outside of the pump. Multiphase pumps and gas handlers are distinguished from gas separators in that they thoroughly mix and condition the gas-liquid mixture to reduce or prevent separation of the gas and liquid and discharge a homogeneous fluid mixture to the ESP pump. However, the high cost of multiphase pumps and gas handlers limits their use in production.

SUMMARY

In a first summary example, a downhole system includes a first tubing and a second tubing arranged within the first tubing to form a first flow path within the second tubing and a second flow path between the second tubing and the first tubing. A pump is disposed within the first tubing. The pump has a discharge end that is fluidly connected to the first flow path. A seal fitting is coupled to a distal end of the first tubing. The seal fitting has a third flow path and a sealing arrangement positioned to isolate the second flow path from a portion of an external environment of the first tubing. A gas separator is positioned to receive a fluid mixture stream from the third flow path. The gas separator has a separation chamber in which the fluid mixture stream is separated into a gas stream and a liquid-rich stream with a free gas content that is lower than that that of the fluid mixture stream. The gas separator has at least a first passage to direct the gas stream into the second flow path and at least a second passage to direct the liquid-rich fluid stream into the pump.

The seal fitting may include a seal receptacle attached to the distal end of the first tubing and a seal adapter received within the seal receptacle. The seal adapter may have a bore that provides the third flow path.

The sealing arrangement may include at least one seal element disposed between the seal receptacle and the seal adapter. The sealing arrangement of the seal fitting may include a first seal element disposed on an inner diameter of the seal receptacle and a second seal element disposed on an outer diameter of the seal adapter. The first seal element may engage with the second seal element to form a seal between the seal receptacle and the seal adapter.

The system may include a motor operatively coupled to the pump and the gas separator. The system may include a seal section positioned to seal the motor from fluids in the portion of the external environment of the first tubing. The system may include one or more sensors to measure one or more parameters in a portion of an external environment of the motor. The gas separator may include a vortex generator.

The bore of the seal adapter may be fluidly connected to the gas separator. The system may include an intake having a bore fluidly connected to the bore of the seal adapter and at least one orifice connecting the bore of the intake to the portion of the external environment of the first tubing. The intake and the gas separator may be attached to opposite ends of the seal adapter. The seal fitting may be positioned at an intermediate location between the motor and the pump. The system may include a power cable attached to an exterior of the second tubing and electrically coupled to the motor. The power cable may extend through a passage in a body of the seal adapter to connect to the motor.

The bore of the seal adapter may be fluidly connected to the gas separator and may be exposed to the portion of the external environment of the first tubing. The motor may be disposed within the second tubing. The system may include a power cable disposed within the second tubing and electrically coupled to the motor.

In a second summary example, a production system includes a production tubing extending from a wellhead at a surface into a well. The production tubing is positioned in the well to form an annulus between the production tubing and the well. The system includes a coiled tubing extending from the wellhead at the surface into the production tubing. The coiled tubing is arranged within the production tubing to form a first flow path within the coiled tubing and a second flow path between the coiled tubing and the production tubing. A pump is disposed within the production tubing. The pump has a discharge end fluidly connected to the first flow path. A seal receptacle is attached to a distal end of the production tubing. A seal adapter is received within the seal receptacle. The seal adapter has a bore to receive a fluid mixture stream from a portion of the well below the production tubing. At least one seal element is disposed between the seal receptacle and the seal adapter to isolate the second flow path from the portion of the well below the production tubing. A gas separator is positioned to receive a fluid mixture stream from the third flow path. The gas separator has a separation chamber in which the fluid mixture stream is separated into a gas stream and a liquid-rich stream with a free gas content that is lower than that of the fluid mixture stream. The gas separator has at least a first passage to direct the gas stream into the second flow path and at least a second passage to direct the liquid-rich fluid stream into the pump.

The production system may include a packer disposed in the annulus to isolate a portion of the annulus connected to the surface from the portion of the well below the production tubing. The system may include a motor operatively coupled to the pump and the gas separator.

In a third summary example, a method of performing an operation in a well includes disposing a first tubing in the well, disposing a second tubing within the first tubing to form a first flow path within the second tubing and a second flow path between the second tubing and the first tubing. The method includes fluidly connecting a discharge end of the pump to the first flow path and fluidly connecting a gas separator to the pump and the second flow path. The method includes isolating the second flow path from a portion of the well below the first tubing. The method includes receiving a fluid mixture stream from the well inside the gas separator. The method includes, by the gas separator, separating the fluid mixture stream into a gas stream and a liquid-rich fluid stream with a free gas content that is lower than that of the fluid mixture stream. The method includes simultaneously producing the gas stream and the liquid-rich fluid stream to the surface by directing the gas stream from the gas separator into the second flow path and directing the liquid-rich fluid stream from the gas separator into the pump while operating the pump.

The act of isolating the second flow path from the portion of the well below the first tubing may include attaching a seal receptacle to the first tubing, attaching a seal adapter to the gas separator, receiving the seal adapter within the seal receptacle, and forming a seal between the seal adapter and the seal receptacle.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
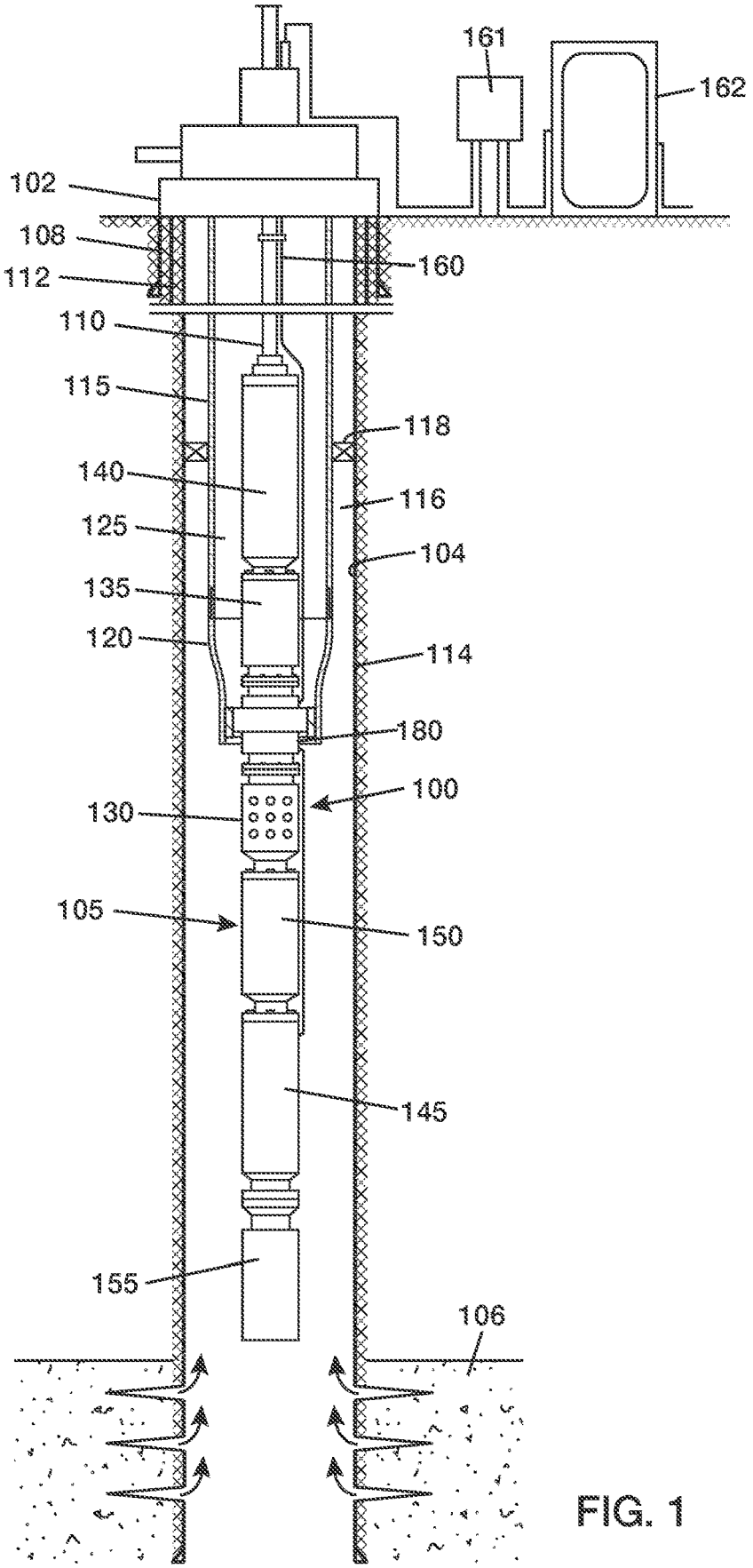
FIG. 1 is a schematic diagram of an ESP system deployed in a production tubing in a well.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

FIG. 1 shows an exemplary ESP system 100 including an ESP assembly 105 attached to an end of a coiled tubing 110. ESP system 100 is disposed in a production tubing 115 extending from a wellhead 102 at a surface into a well 104 below the surface. For illustrative purposes, well 104 traverses a subsurface zone 106, which may contain reservoir fluids such as hydrocarbons. Casings 108, 112, 114 may be installed in well 104—the number of casings are merely for illustrative purposes. Innermost casing 114 may extend into subsurface zone 106 and may include perforations to allow reservoir fluids from subsurface zone 106 to flow into well 104. An annulus 116 is formed between casing 114 (or wall of well 104) and production tubing 115. A packer 118 is arranged in annulus 116 to prevent fluids from below the production tubing from moving to the surface via annulus 116. ESP assembly 105 is arranged near a bottom end of production tubing 115, while coiled tubing 110 extends from ESP assembly 105 to the surface and is appropriately supported at the surface, e.g., by a reel system that is not shown. ESP system 100 and production tubing 115 are arranged in well 104 to transport fluids from well 104 to wellhead 102 at the surface.

Figure 2:
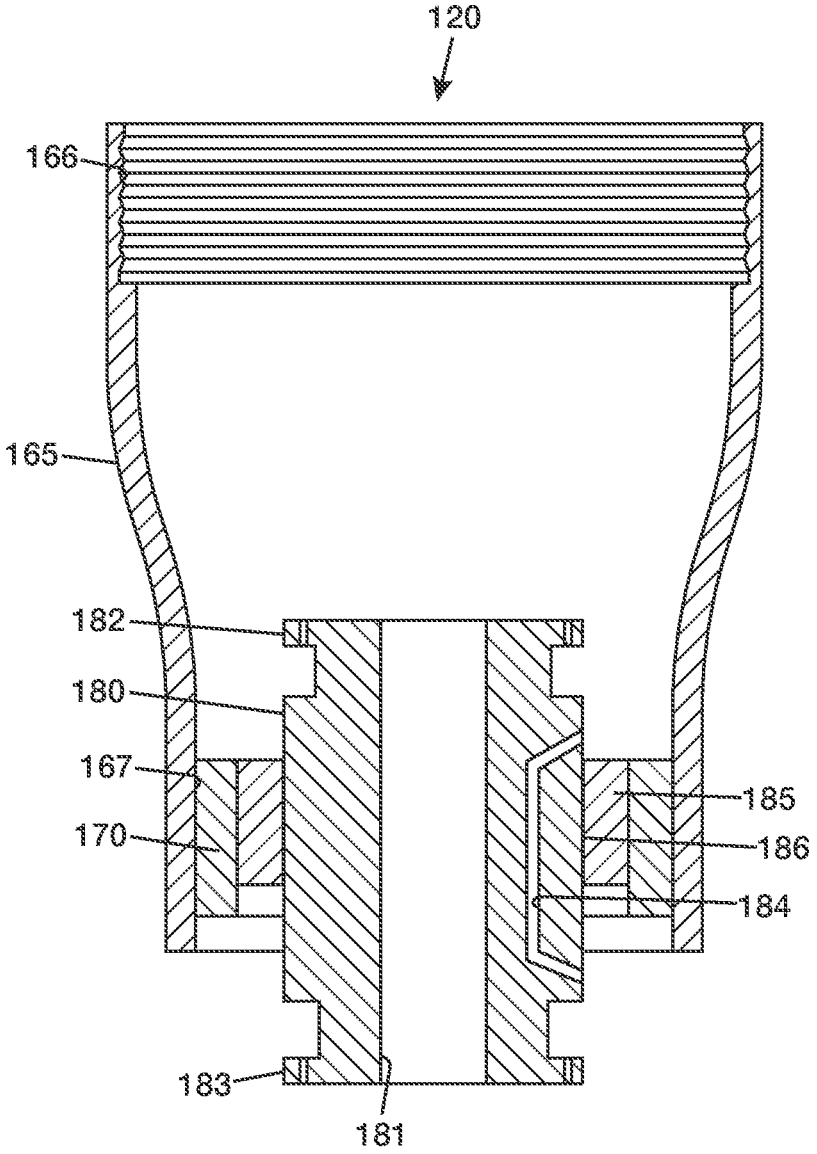
FIG. 2 is a cross-sectional view of a seal fitting of the ESP system of FIG. 1.

ESP assembly 105 includes a seal fitting 120 that engages production tubing 115. As shown more clearly in FIG. 2, seal fitting 120 includes a seal receptacle 165 and a seal adapter 180 received within seal receptacle 165. Seal receptacle 165 may be a so-called seal bore, which is a receptacle in which another component can be inserted to form an interference fit or seal and which can act as a flow and/or pressure barrier. An upper end portion of seal receptacle 165 may include a threaded surface 166 or other feature to connect seal receptacle 165 to the bottom end portion of a production tubing, as shown in FIG. 1. Seal receptacle 165 carries a seal element 170. In one example, seal element 170 may be a packing or surface lining a portion of an inner wall surface 167 of seal receptacle 165. As an example, seal element 170 may be made of an elastomer or other material to form a seal. Seal elastomer material could include, for example, fluoroelastomers, hydrogenated nitrile elastomer, hydrogenated nitrile butadiene rubber, and Viton rubber. Seal element 170 may be bonded or attached to a portion of inner wall surface 167 of seal receptacle 165 during manufacture of seal receptacle 165. Alternatively, seal element 170 may be formed by honing a portion of inner wall surface 167 of seal receptacle 165 for proper sealing and optionally applying a coating to the honed surface to improve the wear resistance of the surface. Examples of coatings are tungsten carbide coatings, silicon carbide coatings, or similar coatings with superior wear and abrasion resistance. Seal element 170 has a ring shape to provide circumferential sealing around a component inserted into seal receptacle 165.

Seal adapter 180 may be a generally tubular body having a main bore 181 and end connections 182, 183. End connections 182, 183 may be flanges with holes to receive bolts. A passage 184 may be formed in a body of seal adapter 180 for passage of a power cable. A seal element 185 is disposed on an outer wall surface 186 of seal adapter 180. Seal element 185 may be an annular packing circumscribing and engaged with a portion of outer wall surface 186 of seal adapter 180. Seal element 185 may be secured to outer wall surface 186 by a suitable means, e.g., by bonding or by fasteners. Seal elastomer material could include, for example, fluoroelastomers, hydrogenated nitrile elastomer, hydrogenated nitrile butadiene rubber, and Viton rubber. The outer diameter of seal adapter 180 and the radial thickness of seal element 185 are selected such that when seal adapter 180 is disposed in seal receptacle 165, seal elements 185, 170 engage with each other and form a seal barrier between seal receptacle 165 and seal adapter 180. An alternative to seal elements 170, 185 is to provide an annular swellable packer on the outer diameter of seal adapter 180 that engages inner wall surface 167 of receptacle 165. When exposed to fluid for a period of time, the swellable packer will expand to form a reliable seal barrier between seal receptacle 165 and seal adapter 180.

Returning to FIG. 1, ESP assembly 105 can be coupled to production tubing 115 via seal fitting 120, and both ESP assembly 105 and production tubing 115 can be run into the well in the same deployment process. Alternatively, since seal fitting 120 is generally in a two-part form, the outer part of seal fitting 120, i.e., seal receptacle 165 and seal element 170 (or seal receptacle only in the alternative implementation that uses a swellable packer), may be pre-installed on production tubing 115 and run into the well with the production tubing. Subsequently, the inner part of seal fitting 120, i.e., seal adapter 180 and seal element 185 (or swellable packer in the alternative implementation), with the remaining components of ESP assembly 105 can be run into the production tubing that is already in the well and then docked into the pre-installed outer part of seal fitting 120 on the production tubing. As shown in FIG. 1, ESP assembly 105 is in the form of an elongated tool, and seal fitting 120 is at an intermediate position in ESP assembly 105. When seal fitting 120 couples ESP assembly 105 to production tubing 115 as shown, a portion of ESP assembly 105 extends below production tubing 115. In addition, an annular passage 125 is formed between ESP system 100 and production tubing 115 within production tubing 115.

As shown more clearly in FIG. 3, sealing elements 170, 185 of seal fitting 120 (or a swellable packer if used instead of sealing elements 170, 185) provide a sealing arrangement that seals annular passage 125 at the bottom, i.e., annular passage 125 is isolated from the portion of well 104 below production tubing 115. This means that fluid in annular passage 125 cannot flow into well 104, which allows annular passage 125 to serve as a flow path to transport a fluid stream from ESP assembly 105 to a surface location. In one implementation, ESP assembly 105 includes an intake 130 positioned below seal fitting 120. When ESP assembly 105 is coupled to production tubing 115 via seal fitting 120, intake 130 extends below production tubing 115 and is exposed to fluids in the well. In general, intake 130 serves as an entry point of well fluids, e.g., reservoir fluids from subsurface zone 106 in FIG. 1, into the ESP system. ESP assembly 105 includes a gas separator 135 positioned above seal fitting 120 and a pump 140 positioned above gas separator 135. Intake 130 is in fluid communication with gas separator 135 through seal fitting 120, and gas separator 135 is in fluid communication with pump 140. The discharge end of pump 140 is fluidly connected to coiled tubing 110.

A fluid mixture stream enters intake 130 from well 104. The fluid mixture stream flows from intake 130 to gas separator 135 through seal fitting 120. Gas separator 135 operates to separate the fluid mixture stream into a gas stream and a liquid-rich fluid stream. The liquid-rich fluid stream has a free gas content that is lower than the initial free gas content in the fluid mixture stream. Gas separator 135 may be a vortex gas generator or other type of gas generator capable of separating gas out of a fluid mixture stream and that can be deployed through a tubing. Other types of gas separators that may be used include reverse flow gas separators, paddle-wheel rotary gas separators, and rotating chamber gas separators. Gas separator 135 discharges the gas stream into annular passage 125, while the liquid-rich fluid stream continues to move upwards into an inlet end of pump 140. Pump 140 increases the pressure head of the liquid-rich fluid stream and discharges the pressurized liquid-rich fluid stream into coiled tubing 110. The gas stream discharged into annular passage 125 moves up annular passage 125. Simultaneously, the liquid-rich fluid stream discharged into coiled tubing 110 moves up coiled tubing 110. In this manner, the ESP system enables simultaneous production of gas and liquid to the surface through production tubing 115.

Figure 4:
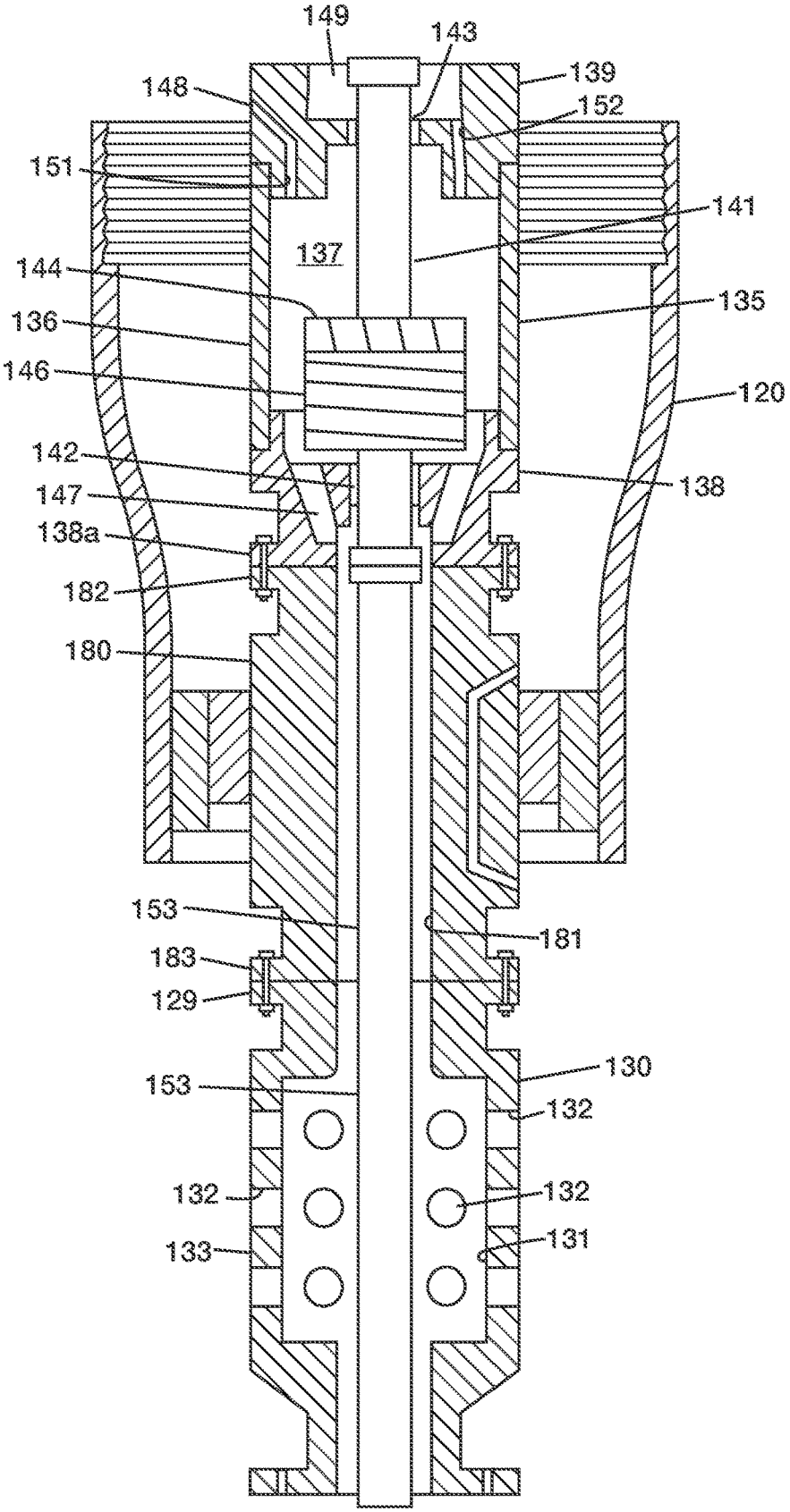
FIG. 4 is a cross-sectional view of a portion of the ESP system of FIG. 1.

FIG. 4 shows an example of fluid communication from intake 130 to gas separator 135 through seal fitting 120. In general, intake 130 may have any suitable structure to receive external fluid and transfer the external fluid to seal fitting 120. In the illustrated example, intake 130 has a connection end 129 that is attached to connection end 183 of seal adapter 180 of seal fitting 120. Intake 130 has a main bore 131 that is aligned with and in fluid communication with main bore 181 of seal adapter 180. Orifices 132 are formed in a wall of intake 130 and are connected to bore 131. Orifices 132 may have any suitable shape to admit fluid into bore 131. A screen may be arranged on the outside wall surface 133 of intake 130 to limit entry of solid particles into bore 131 through orifices 132. A fluid mixture stream that enters bore 131 of intake 130 through orifices 132 can then flow into bore 181 of seal adapter 180.

In the illustrated example of gas separator 135 shown in FIG. 4, which is not to be considered as limiting, gas separator 135 includes a sleeve 136 in which a separation chamber 137 is defined. Bearing housings 138, 139 are mounted at opposite ends of sleeve 136. Bearing housing 138 has a connection end **138*a* that is attached to connection 182 of seal adapter 180 of seal fitting 120. A shaft 141 extends through axially aligned bores in bearing housings 138, 139 and through separation chamber 137. Shaft 141 is supported for rotation about an axial axis of sleeve 136 by bearings 142, 143 in bearing housings 138, 139, respectively. A vortex generator 144 is mounted on shaft 141 and disposed in separation chamber 137. Vortex generator 144** may be, for example, a radial impeller. An inducer 146 is mounted on shaft 141 and upstream of vortex generator 144. Inducer 146 may be, for example, an axial impeller. Both vortex generator 144 and inducer 146 rotate with shaft 141.

Bearing housing 138 includes one or more flow passages 147 that fluidly connect bore 181 of seal adapter 180 to separation chamber 137. An opening 148 is formed at a side of bearing housing 139 that will be exposed to the annular passage (125 in FIG. 3), and an opening 149 is formed at a top of bearing housing 138 that will be exposed to the pump (140 in FIG. 3). Bearing housing 139 includes a flow passage 151 that connects side opening 148 to separation chamber 137 and a flow passage 152 that connects top opening 149 to separation chamber 137. A fluid mixture stream from intake 130 is received in separation chamber 137 via flow passage(s) 147. Inducer 146 may increase the pressure of the fluid mixture stream to prevent cavitation. Vortex generator 144 then acts on the fluid mixture stream to separate the fluid mixture stream into a gas stream and a liquid-rich fluid stream. The gas stream exits separation chamber 137 through flow passage 151 and side opening 148. The liquid-rich fluid stream exits separation chamber 137 through flow passage 152 and top opening 149.

Returning to FIG. 3, pump 140 may be a centrifugal pump or a progressive cavity pump or other ESP pump. If pump 140 is a centrifugal pump, pump 140 may have one or more pump stages, each pump stage including an impeller and a diffuser connected to a rotatable shaft. If pump 140 is a progressive cavity pump, the pump would include a helical rotor nested inside a stator. The helical rotor is connected to a rotatable shaft. In either example of pump 140, there is a pump shaft to be rotated in order to increase the pressure head of a fluid stream. ESP assembly 105 includes an electric motor 145 to rotate the shaft of pump 140. Motor 145 may also rotate the shaft (141 in FIG. 4) of gas separator 135. Motor 145 may be any suitable ESP motor, such as a three-phase induction motor or a permanent magnet motor. In the arrangement shown in FIG. 3, motor 145 is arranged below intake 130, which is below gas separator 135. In this position, the shaft of motor 145 can be mechanically coupled to the shaft of gas separator 135 and the shaft of pump 140 in order to drive both the gas separator and pump.

In one example, an ESP seal section 150 is attached to motor 145 and intake 130. ESP seal section 150 may be any suitable ESP seal section, also known as ESP protector or ESP protector seal, known in the art. ESP seal section 150 prevents well fluids from migrating into motor 145. ESP seal section 150 may also perform other functions such as transferring torque from motor 145 to pump 140 and gas separator 135 and providing pressure equalization between motor 145 and the well. In one example, ESP seal section 150 includes a seal section shaft that is coupled at one end to a shaft of motor 145. The seal section shaft then extends through main bore 131 of intake 130 and main bore 181 of seal adapter 180, as shown at 153 in FIG. 4, and is coupled to shaft 141 of gas separator 130. Shaft 141 of gas separator 130 is coupled to the shaft of pump 140. In this manner, motor 145 is mechanically coupled to drive gas separator 135 and pump 140, and ESP seal section 150 plays a role in transferring torque from motor 145 to gas separator 135 and pump 140.

Returning to FIGS. 1 and 3, ESP assembly 105 may include a monitoring tool 155 attached below motor 145. Monitoring tool 155 may include one or more sensors to measure one or more downhole parameters related to operation of the ESP system or related to an environment around motor 145. Motor 145, ESP seal section 150, and monitoring tool 155 may be provided as separate units that are then connected together in the ESP assembly or may be integrated into a single housing. Electrical power is delivered to motor 145 from the surface via a power cable 160 that is banded to an exterior of coiled tubing 110. FIG. 1 shows power cable 160 connected to a junction box 161 at the surface. Junction box 161 is connected to a control panel 162, which is connected to transformers (not shown). Power cable 160 passes through the body of seal adapter 180, i.e., passage 184 shown in FIG. 2, and exits below seal adapter 180 to connect to motor 145. In addition to power cable 160 providing electrical power to motor 145, power cable 160 may carry data from monitoring tool 155 to control panel 162 at the surface.

Figure 3:
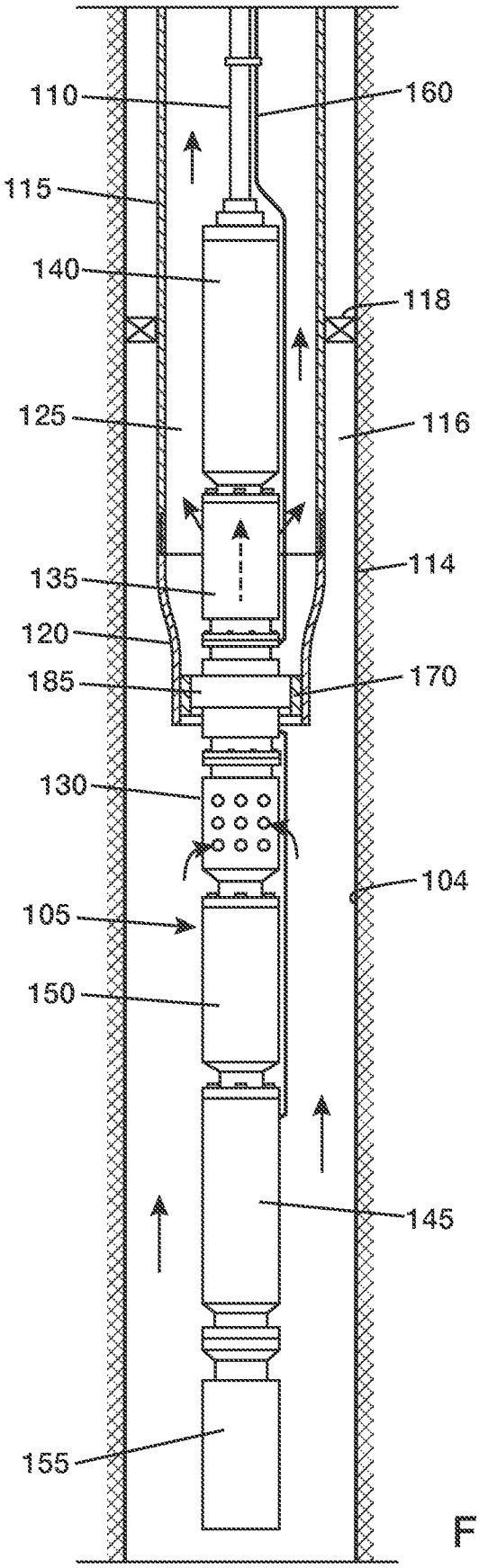
FIG. 3 is an enlargement of a section of the system of FIG. 1.

Referring to FIGS. 1 and 3, a method of producing fluid from well 104 includes installing production tubing 115 in well 104 and installing packer 118 in casing or well annulus 116. The method includes deploying ESP system 100 into production tubing 115. Installation of production tubing 115 and deployment of ESP system 100 may be carried out simultaneously. Alternatively, ESP system 100 may be deployed after installing production tubing 115 in well 104, as previously described. The method includes receiving a fluid mixture stream from the well through intake 130. The fluid mixture stream received inside intake 130 will move up seal adapter 180 into gas separator 135. The method includes supplying electrical power to motor 145 to drive gas separator 135 to separate the fluid mixture stream into a gas stream and a liquid-rich fluid stream. The method includes discharging the gas stream into annular passage 125 and the liquid-rich stream to pump 140. The method includes operating pump 140 with motor 145 to increase the pressure head of the liquid-rich fluid stream and discharge the pressurized liquid-rich fluid stream into coiled tubing 110. The method includes simultaneously producing the gas stream and liquid-rich fluid stream to wellhead 102 at the surface through the annular passage 125 and coiled tubing 110. At the wellhead, both the gas stream and liquid-rich fluid stream are routed to their respective flow lines for further treatment and processing.

Figure 5:
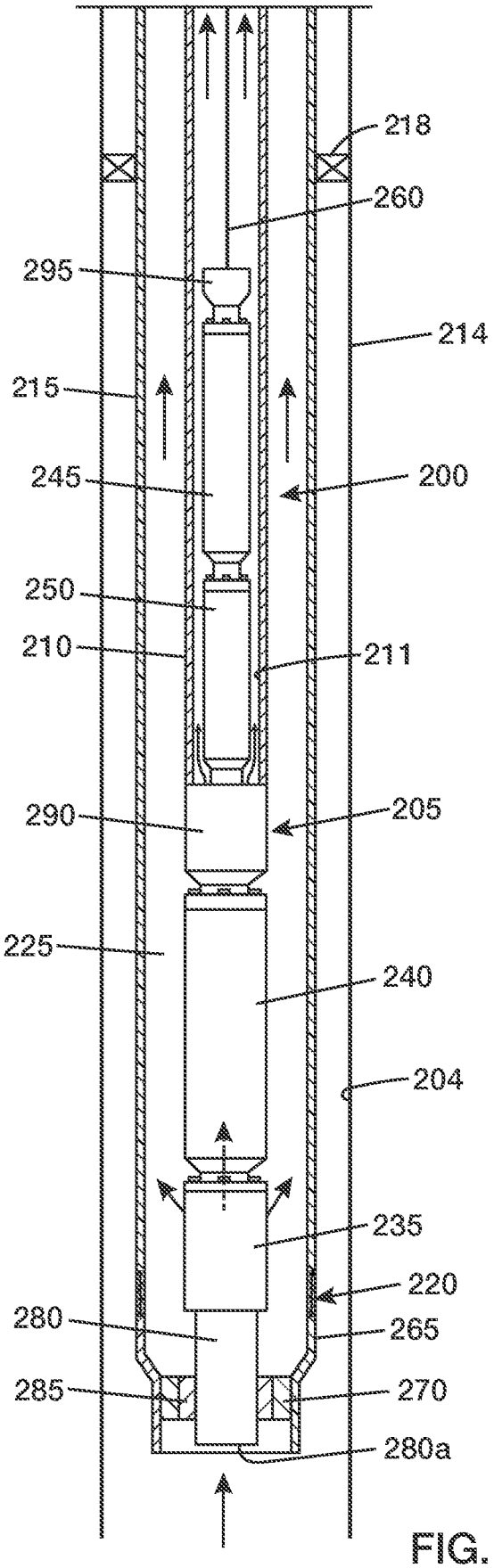
FIG. 5 is a schematic diagram showing an alternative deployment of an ESP system within a production tubing.

FIG. 5 shows an alternatively-deployed ESP system 200. The main difference between ESP system 200 and ESP system 100 (in FIG. 1) is in the arrangement of the downhole components of the ESP systems. In particular, the arrangement of the components of ESP system 200 is inverted compared to the arrangement of the components of ESP system 100. In FIG. 5, ESP assembly 205 of ESP system 200 includes seal fitting 220 having seal receptacle 265 and seal adapter 280 received within seal receptacle 265. Seal adapter 280 may be a so-called stinger, which is a cylindrical rod with a through-bore for fluid passage. The bore of seal adapter 280 is exposed to well 204 and can receive fluids from well 204. A seal arrangement is positioned between seal receptacle 265 and seal adapter 280. The seal arrangement may include a seal element 270 carried by seal receptacle 265 and a seal element 285 carried by seal adapter 280. The characteristics of seal elements 270, 285 may be as described for seal elements 170, 185 (in FIG. 2).

Figure 6:
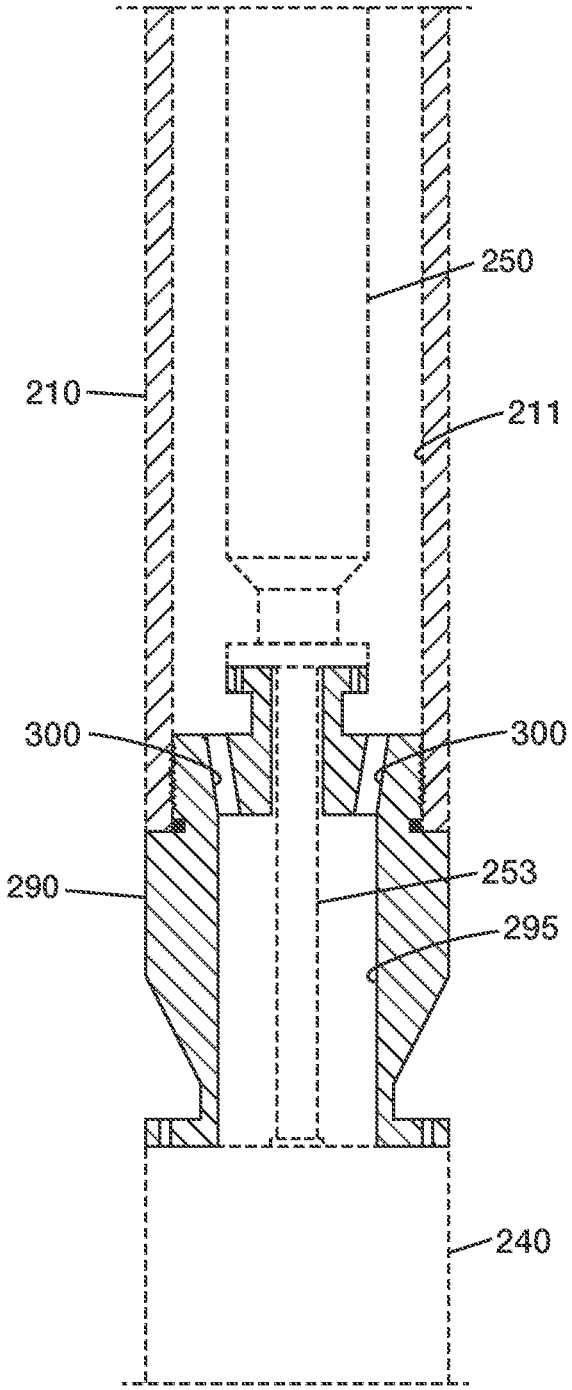
FIG. 6 is a partial cross-sectional view of a portion of the ESP system of FIG. 5 including a discharge adapter.

Gas separator 235 is attached above seal adapter 280, e.g., by a threaded connection. Gas separator 235 may have the same characteristics as described for gas separator 135 (in FIGS. 1, 3, and 4). Pump 240 is attached above gas separator 235. Pump 240 may have the same characteristics as described for pump 140 (in FIGS. 1, 3, and 4). ESP assembly 205 includes a discharge adapter 290 attached to pump 240. A coiled tubing 210 is attached to a body of discharge adapter 290, e.g., by a threaded connection. As shown in FIG. 6, discharge adapter 290 has a bore 295 and flow passages 300 connected to bore 295. Bore 295 and flow passages 300 fluidly connect the discharge end of pump 240 to a bore 211 of coiled tubing 210. Referring to FIGS. 5 and 6, attached above discharge adapter 290 and inside bore 211 of coiled tubing 210 are ESP seal section 250 and motor 245. ESP seal section 250 and motor 245 may have the same characteristics described for ESP seal section 150 and motor 145 (in FIGS. 1, 3, and 4), respectively. Motor 245 drives pump 240 and gas separator 235 via a shaft. ESP seal section 250 may include a shaft 253 (in FIG. 6), which has one end that is coupled to a shaft of motor 245 and another end that is coupled to a shaft of pump 240. The shaft of ESP seal section 250 passes through bore 295 (in FIG. 6) of discharge adapter 290. The shaft of pump 240 is coupled to a shaft of gas separator 235. In this manner, motor 245 can be operated to drive the shaft of pump 240 and the shaft of gas separator 235. A power cable 260 received within bore 211 of coiled tubing 210 is coupled to motor 245 by a cable adapter 295. Power cable 260 is connected to a power supply at the surface, as described for power cable 160 (in FIG. 1).

Seal receptacle 265 is attached to a bottom end of production tubing 215 in the same manner described for seal receptacle 165 and production tubing 115 in FIGS. 1, 3, and 4. An annular passage 225 is formed between production tubing 215 and ESP system 200. Annular passage 225 is sealed at the bottom by seal elements 270, 285 between seal receptacle 265 and seal adapter 280. Packer 218 is arranged between production tubing 215 and a casing 214 in well 204 and performs the same function as described for packer 118 (in FIGS. 1 and 2). A fluid mixture stream from well 204 enters the bore of seal adapter 280 through a bore opening at an end **280*a* of seal adapter 280. From the bore of seal adapter 280, the fluid mixture stream flows into gas separator 235, where the fluid mixture stream is separated into a gas stream and a liquid-rich fluid stream, as previously described. The gas stream is discharged into annular passage 225, while the liquid-rich fluid stream is discharged into pump 240. Pump 240 pressurizes the liquid-rich fluid stream and discharges the pressurized liquid-rich fluid stream into bore 211 of coiled tubing 210 through discharge adapter 290. The gas stream moves up annular passage 225 to the surface, and the liquid-rich fluid stream moves up coiled tubing 210** to the surface.

ESP systems 100, 200 may enable production of gas and liquid from high gas-content oil wells. ESP systems 100, 200 may enable removal of water of condensates build-up from producing gas wells, i.e., gas well deliquification. ESP systems 100, 200, using gas separators, are expected to be more economical compared to systems using multiphase pumps and gas handlers. ESP systems 100, 200 may be used in regions where production up the casing annulus is prohibited. The seal adapters in the seal fittings of ESP systems 100, 200 can be retrofitted to any pumping configuration, which would facilitate integration of the ESP systems into existing ESP equipment architecture.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A system comprising:

a first tubing;

a second tubing arranged within the first tubing to form a first flow path within the second tubing and a second flow path between the second tubing and the first tubing;

a pump disposed within the first tubing, the pump having a discharge end fluidly connected to the first flow path;

a seal fitting comprising a seal receptacle attached to the distal end of the first tubing and a seal adapter received within the seal receptacle and coupled to a distal end of the first tubing, the seal fitting having a third flow path defined therethrough and a sealing arrangement positioned to isolate the second flow path from a portion of an external environment of the first tubing, wherein the sealing arrangement comprises a first seal element disposed on an inner diameter of the seal receptacle and a second seal element disposed on an outer diameter of the seal adapter, the first seal element engageable with the second seal element to form a seal between the seal receptacle and the seal adapter; and a gas separator positioned to receive a fluid mixture stream from the third flow path, the gas separator having a separation chamber in which the fluid mixture stream is separated into a gas stream and a liquid-rich fluid stream with a free gas content that is lower than that of the fluid mixture stream, the gas separator having at least a first passage to direct the gas stream into the second flow path and at least a second passage to direct the liquid-rich fluid stream into the pump.

2. The system of claim 1, further comprising a motor operatively coupled to the pump and the gas separator.

3. The system of claim 2, further comprising a seal section positioned to seal the motor from fluids in the portion of the external environment of the first tubing.

4. The system of claim 2, further comprising one or more sensors to measure one or more parameters in a portion of an external environment of the motor.

5. The system of claim 2, wherein the gas separator comprises a vortex generator.

6. The system of claim 2, wherein the bore of the seal adapter is fluidly connected to the gas separator, and further comprising an intake having a bore fluidly connected to the bore of the seal adapter and at least one orifice connecting the bore of the intake to the portion of the external environment of the first tubing.

7. The system of claim 6, wherein the intake and the gas separator are attached to opposite ends of the seal adapter.

8. The system of claim 7, further comprising a power cable attached to an exterior of the second tubing and electrically coupled to the motor.

9. The system of claim 8, wherein the seal fitting is positioned at an intermediate location between the motor and the pump, and wherein the power cable extends through a passage in a body of the seal adapter to connect to the motor.

10. The system of claim 2, wherein the bore of the seal adapter is fluidly connected to the gas separator and is exposed to the portion of the external environment of the first tubing.

11. The system of claim 10, wherein the motor is disposed within the second tubing.

12. The system of claim 11, further comprising a power cable disposed within the second tubing and electrically coupled to the motor.

13. A system comprising:

a production tubing extending from a wellhead at a surface into a well, the production tubing positioned in the well to form an annulus between the production tubing and the well;

a coiled tubing extending from the wellhead at the surface into the production tubing, the coiled tubing arranged within the production tubing to form a first flow path within the coiled tubing and a second flow path between the coiled tubing and the production tubing;

a pump disposed within the production tubing, the pump having a discharge end fluidly connected to the first flow path;

a seal receptacle attached to a distal end of the production tubing;

a seal adapter received within the seal receptacle, the seal adapter having a bore to receive a fluid mixture stream from a portion of the well below the production tubing and to provide a third flow path;

a sealing arrangement to isolate the second flow path from the portion of the well below the production tubing; the sealing arrangement comprising a first seal element disposed on an inner diameter of the seal receptacle and a second seal element disposed on an outer diameter of the seal adapter; and a gas separator positioned to receive the fluid mixture stream from the third flow path, the gas separator having a separation chamber in which the fluid mixture stream is separated into a gas stream and a liquid-rich fluid stream with a free gas content that is lower than that of the fluid mixture stream, the gas separator having at least a first passage to direct the gas stream into the second flow path and at least a second passage to direct the liquid-rich fluid stream into the pump.

14. The system of claim 13, further comprising a packer disposed in the annulus to isolate a portion of the annulus connected to the surface from the portion of the well below the production tubing.

15. The system of claim 14, further comprising a motor operatively coupled to the pump and the gas separator.

16. A method comprising:

disposing a first tubing in a well;

disposing a second tubing within the first tubing to form a first flow path within the second tubing and a second flow path between the second tubing and the first tubing;

fluidly connecting a discharge end of a pump to the first flow path;

fluidly connecting a gas separator to the pump and the second flow path;

isolating the second flow path from a portion of the well below the first tubing comprising attaching a seal receptacle to the first tubing, attaching a seal adapter to the gas separator, disposing a first seal element on an inner diameter of the seal receptacle, disposing a second seal element on an outer diameter of the seal adapter, engaging the first seal element with the second seal element, and forming a seal between the seal receptacle and the seal adapter;

receiving a fluid mixture stream from the well inside the gas separator;

by the gas separator, separating the fluid mixture stream into a gas stream and a liquid-rich fluid stream with a free gas content that is lower than that of the fluid mixture stream; and simultaneously producing the gas stream and the liquid-rich fluid stream to the surface by directing the gas stream from the gas separator into the second flow path and directing the liquid-rich fluid stream from the gas separator into the pump while operating the pump.

* * * * *